United States Patent [19]

Torii et al.

[11] Patent Number: 4,857,809

[45] Date of Patent: Aug. 15, 1989

[54] MICROWAVE ION SOURCE

[75] Inventors: Yasuhiro Torii; Seitaro Matsuo; Iwao Watanabe; Masaru Shimada, all of Kanagawa, Japan

[73] Assignee: Nippon Telegraph and Telephone Corporation, Tokyo, Japan

[21] Appl. No.: 210,137

[22] Filed: Jun. 27, 1988

Related U.S. Application Data

[63] Continuation of Ser. No. 743,166, Jun. 10, 1985, abandoned.

[30] Foreign Application Priority Data

Jun. 11, 1984 [JP] Japan ..... 59-118258

[51] Int. Cl.[4] ..... H01J 7/24

[52] U.S. Cl. ..... 315/111.31; 315/39; 315/111.41; 315/111.81

[58] Field of Search ..... 315/39, 111.41, 111.81, 315/111.31; 313/363, 364; 250/423 R

[56] References Cited

U.S. PATENT DOCUMENTS

| | | | |
|---|---|---|---|
| 4,058,748 | 11/1977 | Sakudo et al. | 315/39 |
| 4,393,333 | 7/1983 | Sakudo et al. | 315/39 |
| 4,409,520 | 10/1983 | Koike et al. | 313/156 |
| 4,507,588 | 3/1985 | Asmussan et al. | 315/39 |
| 4,523,127 | 6/1985 | Moeller | 315/39 |
| 4,598,231 | 7/1986 | Matsuda et al. | 315/39 |
| 4,631,438 | 12/1986 | Jacquot | 315/111.81 |
| 4,658,143 | 4/1987 | Tokiguchi et al. | 315/111.81 |

*Primary Examiner*—Leo H. Boudreau
*Assistant Examiner*—Michael Razavi
*Attorney, Agent, or Firm*—Blakely, Sokoloff, Taylor & Zafman

[57] ABSTRACT

In a microwave ion source utilizing a microwave and a magnetic field, a microwave introducing window has a multilayer structure of plates with different dielectric constants, a magnetic circuit is arranged to generate a magnetic field having a higher intensity than that defined by ECR (Electron Cyclotron Resonance) conditions so as to form a narrow high-density plasma, an ion extraction electrode has an ion extraction window whose contour falls within a center region of the narrow high-density plasma.

11 Claims, 10 Drawing Sheets

MICROWAVE ION SOURCE

This is a continuation Ser. No. 743,166, filed June 10, 1985, now abandoned.

BACKGROUND OF THE INVENTION

1. Field of the Invention

The present invention relates to a microwave ion source using an ion extraction electrode system with a number of apertures and, more particularly, to a microwave ion source in an ion implanter used in impurity doping, material synthesis, surface modification or new material development.

2. Description of the Prior Art

A conventional large-current ion implanter has an injection ion current of 1 to 10 mA. Semiconductor manufacturing techniques such as SIMOX (Separation by Implanted Oxygen) for forming an $SiO_2$ layer in a silicon substrate by ion-implanting ions at a dose of $10^{18}$ ions/cm$^2$ or more have been recently developed. Along with this development, demand has arisen for developing a large-current ion implanter having an ion current of 50 to 100 mA. In order to develop this type of apparatus, a total ion current must be more than 100 to 200 mA (corresponding to an ion current density of 75 to 150 mA/cm$^2$), and a long lifetime ion source for an active gas such as oxygen is indispensable. It is difficult to obtain such a high-performance ion source even if an ion source used in a conventional ion implanter is improved in performance. For example, ion sources with a thermionic filament are conventionally used since they provide a large ion current density. However, these sources have short lifetime for reactive gases such as oxygen. Therefore, the thermionic filament type ion source cannot provide a practical large-current ion source.

For this reason, a microwave ion source without a filament is expected to be an ion implantion type large-current ion source. However, development and/or study of such an ion source have not substantially be made. No practical applications have been expected for a large-current ion source for, for example, 100 mA ion implanter. For example, in microwave ion sources practically used for ion implanter, as described in U.S. Pat. Nos. 4,058,748 and 4,409,520, a special small discharge space (ridged type, 10×40×40 mm) is used based on an assumption that high-voltage density cannot be obtained by a large discharge space. With this arrangement, a total ion current is about 30 to 40 mA (corresponding to an ion current density of 40 to 50 mA/cm$^2$). In order to obtain a higher ion current with the ridged type, fundamental technical improvements must be made.

A microwave ion source for generating a shower-like ion beam is illustrated in, for example, Japanese Patent Application Laid-open No. 55-141729. However, an ion current density of this ion source is as low as 1 mA/cm$^2$ (corresponding to a total ion current of 80 mA).

No ion source has been proposed wherein long-lifetime and stable operation for a reactive gas are guaranteed, a beam size is about (10 to 20) mm×(20 to 50) mm, and a total ion current is about 100 to 200 mA (corresponding to an ion current density of 75 to 150 mA/cm$^2$). Strong demand has arisen for such large-current ion sources.

SUMMARY OF THE INVENTION

It is an object of the present invention to provide an ion source for ion implanters wherein stable, long-lifetime operation can be performed for a reactive gas such as oxygen gas, and a high density and large current can be obtained.

The present invention has been made based on the finding that a plasma having an entirely different mode from that of a conventional plasma is generated when a magnetic field density is higher than a conventional intensity, as described in Japanese Patent Application Laid-open No. 55-141729. The present invention is based on this particular mode. More particularly, when a magnetic field intensity at least near a microwave introducing window is set at a value higher than that causing electrons to generate an electron cyclotron resonance (to be referred to as ECR hereinafter) phenomenon in accordance with an introduced microwave frequency, a narrow high-intensity plasma mode is generated such that a plasma density is higher at a center region of the plasma generation chamber than at a peripheral portion thereof and rapidly decreases at positions away from the center region. In the technique of Japanese Patent Application Laid-open No. 55-141729 this mode was minimized in order to generate a uniform large-diameter beam. According to the present invention, however, a center region of the narrow high-intensity plasma is effectively utilized to be described later. In order to utilize the center region of the narrow high-intensity plasma, the size of an ion extraction electrode system must be properly determined.

In order to achieve the above object of the present invention, there is provided a microwave ion source utilizing a microwave and a magnetic field, comprising: a plasma generation chamber in which a plasma is generated; a microwave introducing window arranged at an inlet port of the plasma generation chamber for introduction of a microwave, the microwave being introduced to the plasma generation chamber through the microwave introducing window; a magnetic circuit, arranged outside the plasma generation chamber, for generating in the plasma generation chamber a magnetic field having a higher intensity than that given by ECR conditions so as to form a narrow high-density plasma in the plasma generation chamber; and an ion extraction electrode system which has an ion extraction window whose contour falls within a center region of the narrow high-density plasma and which is arranged at an outlet port of the plasma generation chamber for delivery of an ion beam therefrom, whereby the ion beam is extracted from the center region of the narrow high-density plasma, so that optimal extraction conditions are established throughout the entire extraction window, and a high-quality ion beam with little spread is obtained. More particularly, in the narrow high-intensity plasma mode generated when the magnetic field intensity near the microwave introducing window is higher than that subjected to the ECR conditions, a plasma density greatly varies along the radial direction of the plasma generation chamber, as described above. When an ion extraction voltage is set at a given value, the ion extraction direction varies in accordance with the plasma density. Therefore, in the technique in which the ion extraction electrode system has apertures along the entire cross-section of the plasma generation chamber as disclosed in Japanese Patent Application Laid-open No. 55-141729, ions of identical directivity cannot be extracted along the entire region of the chamber. In addition, ions having a directivity such that they cannot pass through a plurality of electrode plates of the ion extraction electrode system become incident on some electrode plates to cause damage thereto. According to the present invention, the size of the window in the ion extraction electrode system is limited so that the high-density plasma, at the center region in the narrow high-density plasma, which has a small density variation is utilized. As a result, the directivity of ions is rendered uniform, an ion beam with small lateral divergence angle can be extracted, and damage to the ion extraction electrode system due to ions with poor directivity is prevented.

The magnetic circuit comprises a plurality of coils surrounding the plasma generation chamber along its longitudinal direction. The magnetic field generated by the coils at the inlet port of the plasma generation chamber is stronger than that at the outlet port thereof. The magnetic field intensity at the inlet port along the lateral direction is substantially uniform.

When the microwave introducing window comprises a double dielectric structure (multiple structure) of a main microwave introducing window provided by partially vacuum sealing the plasma generation chamber and an auxiliary microwave introducing window arranged adjacent to the main window and internally of the plasma generation chamber, damage to the microwave introducing window which is caused by a back stream of electrons can be prevented. At the same time, plasma generation efficiency by the microwave power can be improved and the saturation phenomenon of an ion current with respect to microwave power can be prevented. In particular, the main microwave introducing window comprises a quartz window, and the auxiliary microwave window comprises an alumina window or a double layer structure of alumina and BN, thereby constituting an optimal microwave introducing window.

A plasma limiter having a plasma transport opening is arranged near the outlet port of the plasma generation chamber. The plasma transport opening opposes the ion extraction window of the ion extraction electrode system, so that the ion source performance can be improved. The plasma limiter with the opening aims at (1) reflecting the microwave component which is not absorbed by the plasma and effectively absorbing the residual microwave component in the plasma, (2) preventing overheat of the extraction electrode which is caused by the microwave, (3) separating the plasma generation chamber from the ion extraction electrode to stabilize the plasma in the electrode system, and (4) limiting a gas flow from the plasma generation chamber to the electrode system to improve gas utilization efficiency.

The ion extraction window preferably comprises a plurality of apertures. If the ion extraction window comprises a single large hole, the beam quality and total ion current are limited. However, when a plurality of apertures are formed, a larger current can be obtained without impairing the beam quality. Since a rectangular ion beam is effective for mass-separator used for ion implanter, the ion extraction window is of a rectangular shape. However, the shape of the window may be circular.

When the plasma generation chamber has a cavity whose sectional area is small toward the microwave introducing window and large toward the ion extraction electrode system, the narrow high-density plasma can be obtained more efficiently.

DESCRIPTION OF THE PREFERRED EMBODIMENTS

Figure 1:
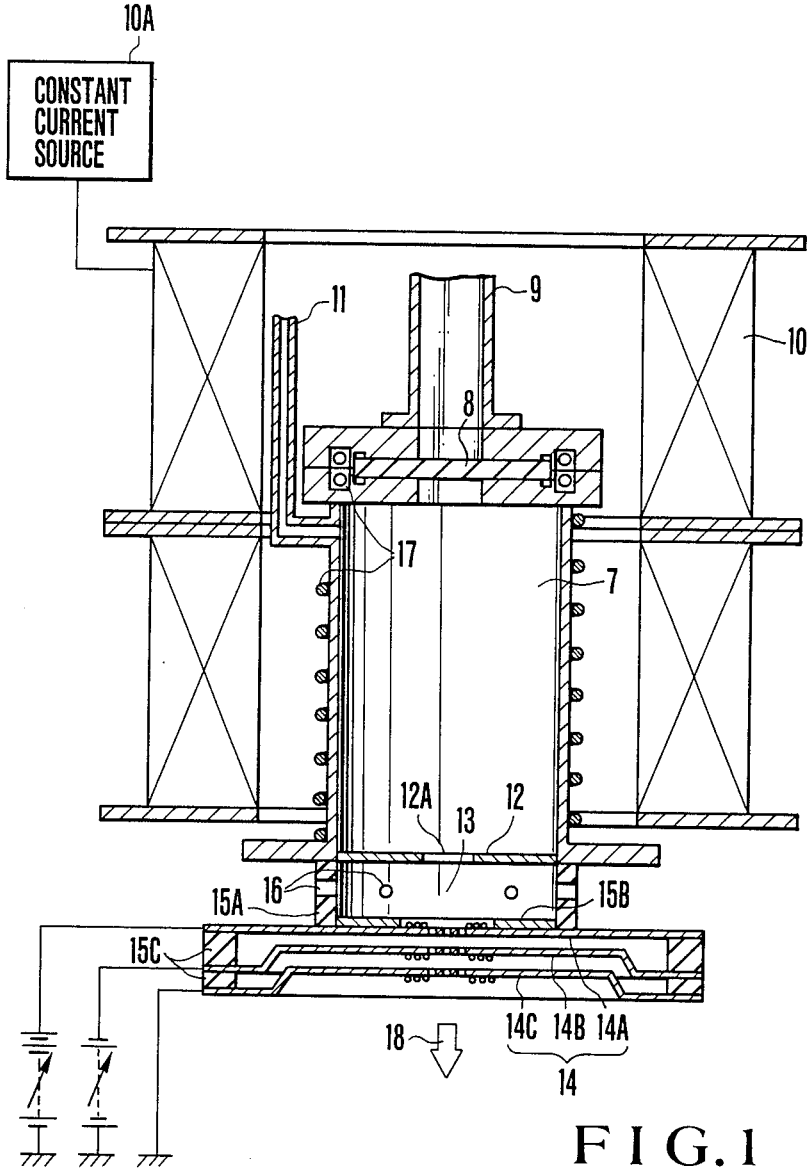
FIG. 1 is a sectional view showing a microwave ion source according to an embodiment of the present invention.

FIG. 1 is a sectional view of a microwave ion source according to an embodiment of the present invention. Referring to FIG. 1, reference numeral 7 denotes a plasma generation chamber made of a stainless steel (SuS) and having a cylindrical cavity; 8, a microwave introducing window; 9, a rectangular waveguide; 10, a magnetic coil which is typically constituted by a multistage structure; 10A, a constant current source; 11, a gas inlet port; 12, a plasma limiter having a rectangular opening 12A for transporting a plasma; 13, a plasma transport chamber; 14, an ion extraction electrode system having a rectangular window consisting of a number of circular or rectangular apertures; 15A, an insulating cylindrical member; 15B, a thin insulating plate; 16, drain openings formed in a side wall of the cylindrical member 15A; 17, a cooling water pipe; and 18, an ion beam. The cylindrical member 15A may comprise a conductor. The waveguide 9 normally has a rectangular shape but is not limited to this. A cavity of the plasma generation chamber 7 may alternatively have a rectangular parallelepiped shape.

Figure 3:
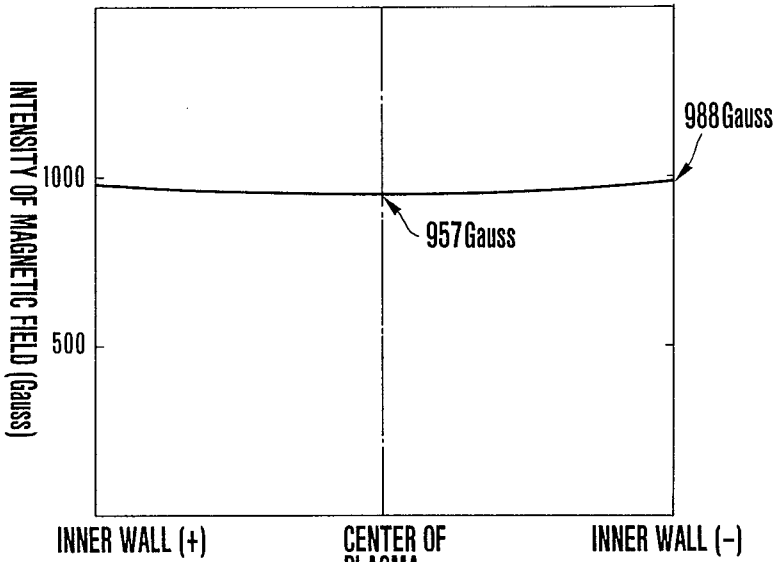
FIGS. 2 and 3 are respectively graphs for explaining a magnetic field of the present invention.
Figure 2:
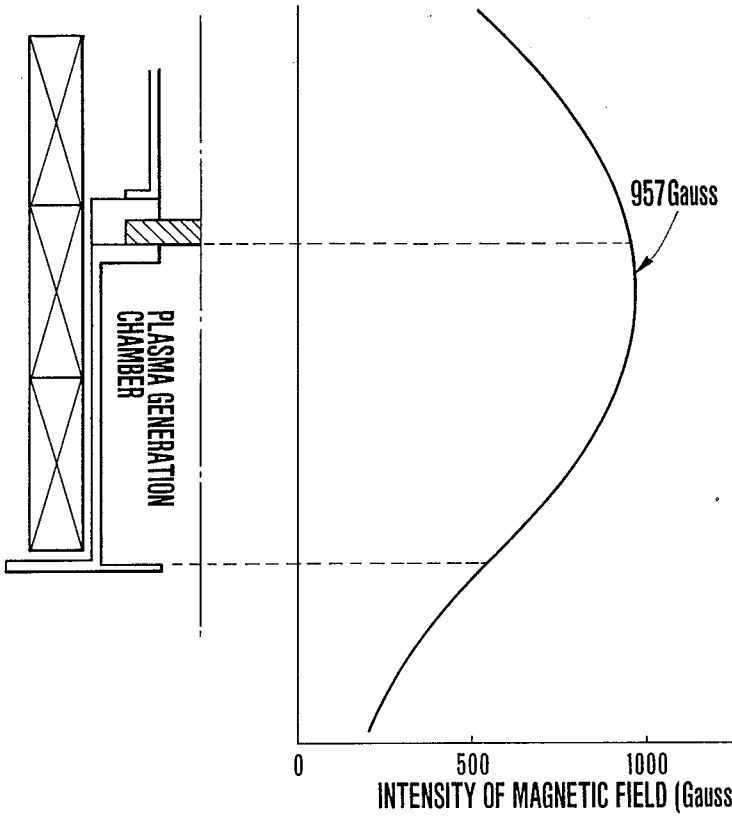

The plasma generation chamber 7 is sealed in a vacuum by the microwave introducing window 8. A gas to be ionized is supplied through the gas inlet port 11. A microwave (generally, 2.45 GHz) is supplied from the rectangular waveguide 9 to the plasma generation chamber 7 through the microwave introducing window 8. The intermediate portion of the magnetic coil 10 is located near the microwave introducing window 8 at the inlet port of the plasma generation chamber 7 to generate a magnetic field which is stronger near the microwave introducing window 8 and weaker near the ion extraction electrode system 14 near the outlet port of the plasma generation chamber 7. Specifically, as shown in FIG. 2, the magnetic field has a longitudinal distribution such that it becomes weaker at the outlet port of the plasma generation chamber 7 than at the inlet port thereof by way of a peak and ultimately becomes divergent near the outlet port. At the same time, as shown in FIG. 3, the magnetic field distribution is uniform near the microwave introducing window along the lateral direction. The intensity of the magnetic field at the center of the plasma generation chamber 7 is, for example, 957 Gauss. In general, when a wave frequency is different from that used in the above case, the application magnetic field must have a field intensity equivalent to that capable of generating the narrow high-density plasma mode. In practice, the intensity falls within the range of 900 to 1,000 Gauss at 2.45 GHz. It should be noted in FIGS. 2 and 3 that a coil current is 155 A, and that the plasma chamber has an inner diameter of 108 mm. A magnetic field intensity for satisfying ECR (electron cyclotron resonance) conditions for a microwave having a frequency of 2.45 GHz is 875 Gauss, and the magnetic coil 10 comprises a coil which provides a maximum intensity of 1,000 Gauss or more in order to generate a narrow high-density plasma. When the gas and the microwave are supplied to the plasma generation chamber 7 and a magnetic field of 875 Gauss for satisfying the ECR conditions is applied inside the plasma generation chamber 7, a plasma is generated in this chamber. The plasma (ions and electrons) tends to move toward the ion extraction electrode system 14 due to the divergent magnetic field of the magnetic coil 10. The plasma is emitted from the rectangular opening 12A formed in the plasma limiter 12 arranged inside the plasma generation chamber 7. The plasma then reaches the ion extraction electrode system 14, so that only the ions are extracted as an ion beam by the system 14. The ion extraction electrode system 14 comprises an acceleration-deceleration electrode structure consisting of a plurality of electrode plates. In this embodiment, the ion extraction electrode system 14 comprises three electrode plates which are insulated from each other by an insulating material 15C. However, the system 14 may comprise a multielectrode structure having three or more electrode plates. In this embodiment, a high voltage of 5 to 50 kV or higher is applied to an acceleration electrode, and a negative voltage of −500 V to several kilovolts, for example, −5 kV is applied to a deceleration electrode 14B, and a ground electrode 14C is grounded. The deceleration electrode 14B has a function for controlling spreading of the extracted ion beam and preventing back stream of external electrons.

An ion source for the ion implanter preferably has a high ion current density at the ion extraction electrode and a small beam spreading angle.

Figure 4:
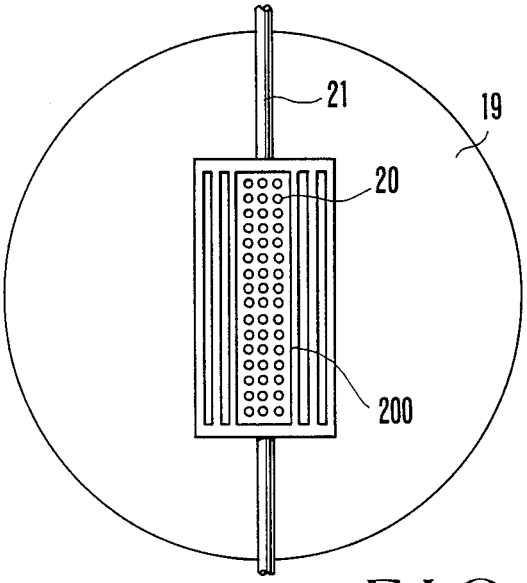
FIGS. 4 and 5 are respectively plan views showing different arrangements of an ion extraction electrode shown in FIG. 1.

In the ion source structure of this embodiment, therefore, the plasma limiter 12 having a rectangular plasma transport opening 12A which is small as compared with the sectional area of the plasma generation chamber 7 is formed in the cavity of the chamber 7 as described above. In this manner, the plasma limiter 12 assists in extracting only a center region of a high-density plasma. The extracted plasma is transported by the divergent magnetic field of the magnetic coil 10 toward the extraction electrode system 14 through the plasma transport chamber 13. Only the center region of the transported plasma is used to cause the ion extraction electrode system 14 to extract ions. The plasma limiter 12 comprises a thin circular plate of Mo or stainless steel which has a thickness 2 to 5 mm and the opening 12A at a position corresponding to the center region of the plasma. As shown in FIG. 4, each electrode plate of the ion extraction electrode system comprises a thin plate 19 of Mo or stainless steel which has a thickness of about 1 to 2 mm and a rectangular ion extraction window 200 consisting of a number of small circular apertures 20. The area of the ion extraction window of the ion extraction electrode system 14 is equal to or smaller than the opening 12A. In this embodiment, the longitudinal direction of the opening 12A and the window of the electrode system 14 is aligned with that of the cross-section of the rectangular waveguide 9. This is because the shape of the center region of the plasma is influenced by the sectional shape of the rectangular waveguide 9 and the extraction of ion beam must be more uniform. In particular, when the elongated rectangular opening 12A or the window of the system 14 is provided, it is preferred to align their longitudinal direction with that of the waveguide.

Figure 5:
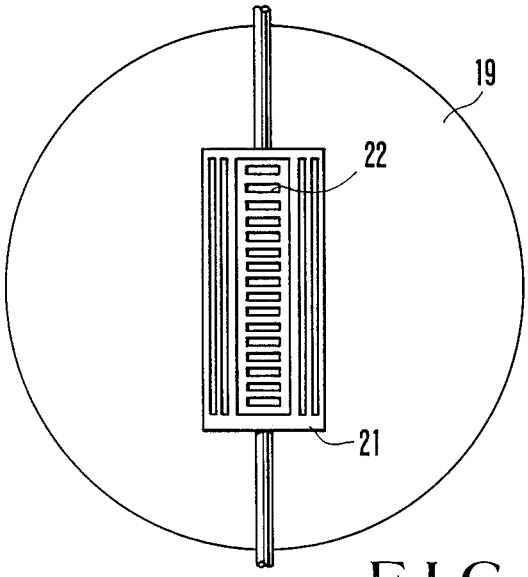

A cooling water pipe 21 is disposed around the ion extraction window consisting of the apertures 20 in the ion extraction electrode system 14 to prevent the extraction electrode from being heated and deformed due to ion bombardment against it. The cooling water pipe 21 can be provided in the space between the adjacent rows of apertures to improve the cooling effect. In the embodiment of FIG. 1, the cooling water pipes 21 are partially embedded at the upper surface side of the thin plate 19 of the acceleration electrode 14A and at the lower surface sides of the thin plates 19 of the deceleration and ground electrodes 14B and 14C. The insulating plate 15B is arranged around the cooling water pipes 21 on the surface of the acceleration electrode 14A to decrease a current flowing in the electrode plate. In general, the ion beam extracted from the large-current ion source for ion implanters is mass-separated through the magnet, so that the extracted beam preferably comprises a rectangular beam. In this embodiment, a rectangular ion extraction window is formed in the ion extraction electrode system 14. However, the ion beam need not be a rectangular, but can have a desired shape in accordance with the design of the ion implanter. The apertures constituting the ion extraction window need not be circular. Rectangular apertures 22 may be used in place of the circular apertures 20, as shown in FIG. 5. In order to effectively absorb microwave power in the plasma, it is preferable that in some applications the cavity of the plasma generation chamber 7 satisfy microwave cavity resonator conditions. For example, in the $TE_{112}$ mode, the length of the cavity is 160 mm when the inner diameter thereof is 110 mm.

Figure 6:
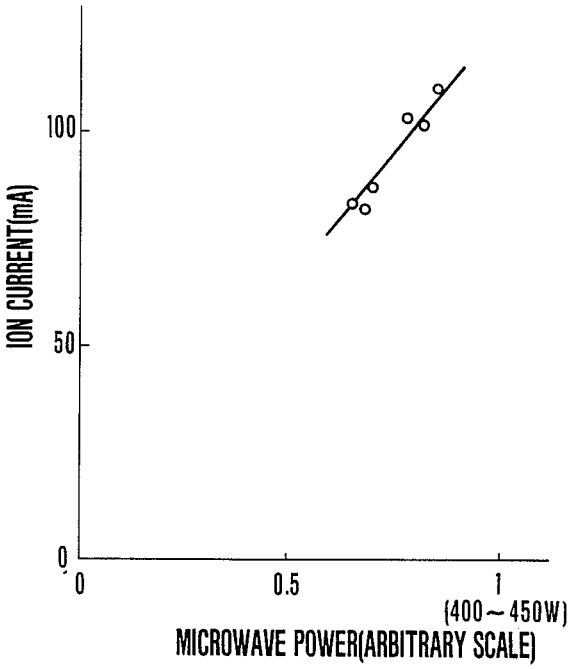
FIGS. 6, 7 and 8 are graphs for explaining ion extraction characteristics of the microwave ion source of FIG. 1.
Figure 7:
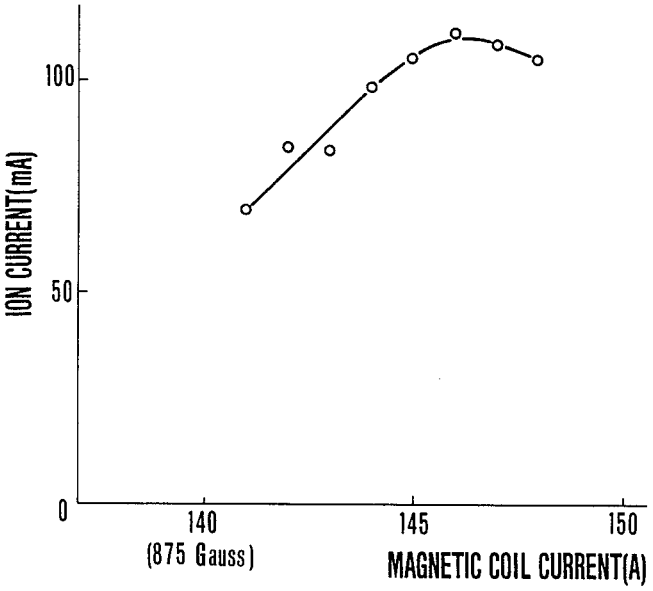

Since the ion extraction window is defined corresponding to the center region of the plasma, the ion extraction conditions are substantially equalized between a number of apertures of the ion extraction electrode system 14, so that good ion extraction can be performed even at a high voltage. For example, when the rectangular plasma transport opening 12A has a size of 30 to 40 mm×60 to 70 mm and the window of the extraction electrode has a size of 2.4×4.6 cm (48 apertures each having a diameter of 3.7 mm), an oxygen ion current of 100 to 120 mA is obtained at an acceleration voltage of 20 kV and can be calculated to correspond to a current density of 20 to 23 mA/cm$^2$. As compared with the conventional ion source, a large current density can be obtained. In an ion extraction electrode having a circular ion extraction window (with a diameter of 20 mm) consisting of 37 circular apertures, an oxygen ion current of 49 mA is obtained at an acceleration voltage of 9 kV and can be calculated to correspond to a current density of 42 mA/cm$^2$. In this manner, a high-density large-current ion source can be realized by optimizing the ion extraction electrode system. In an experiment using oxygen, no change in ion source characteristics was observed, and the ion source was stably operated. Typical characteristics are shown in FIGS. 6 and 7 when an ion extraction electrode system has 48 apertures each having a diameter of 3.7 mm. FIG. 6 is a graph showing the ion current as a function of microwave power at an acceleration voltage of 20 kV. As is apparent from FIG. 6, an ion current of 100 mA or more can be obtained at a microwave power of about 350 W. When microwave power is increased, a large-current ion source can be obtained. FIG. 7 is a graph showing the oxygen ion current as a function of magnetic coil current (magnetic field intensity) at an acceleration voltage of 19 kV. A plasma can be stably generated on the ECR conditions (i.e., 875 Gauss). However, in this invention, the current of the magnetic coil provides a magnetic field having a higher intensity than that for the ECR conditions so as to obtain a maximum ion current. More particularly, a magnetic coil current of 146 A in FIG. 7 corresponds to 912 Gauss. The above conditions vary in accordance with, especially, the gas flow rate and the microwave power. In practice, the ion source is operated to obtain optimal conditions.

In the measurement of FIG. 7, the ion extraction electrode has an ion extraction having 6×8 apertures in a rectangular shape. Each aperture has a diameter of 3.7 mm. The microwave introducing window comprises a double structure of quartz and alumina.

Figure 8:
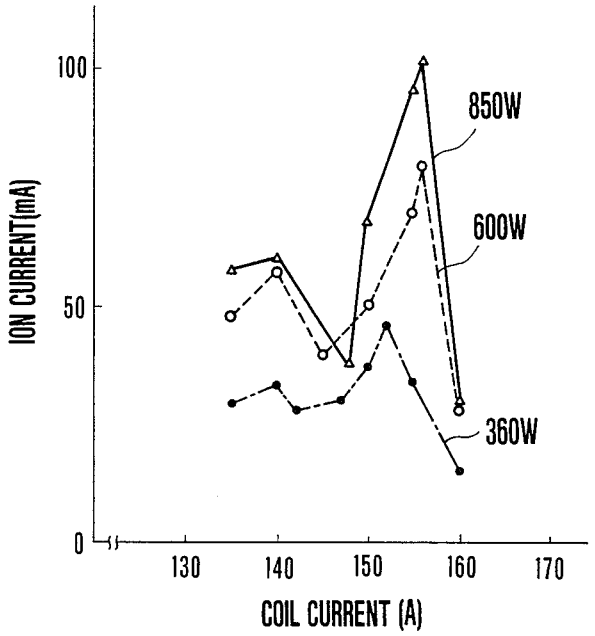

FIG. 8 shows the same relationship as that of FIG. 7 under, however, different measuring conditions. During measurement of FIG. 8, a microwave power level of 360 to 850 W is used. An ion extraction window of an ion extraction electrode system has seven circular apertures (each having a diameter of 4.2 mm) arranged in a circular configuration (having a radius of 20 mm; and one aperture is located at the center of a hexagon, and the remaining six apertures are located at vertices of the hexagon). A microwave introducing window comprises a double structure of quartz and alumina. An ion current density higher than that in the case of FIG. 7 is obtained in FIG. 8.

Figure 9:
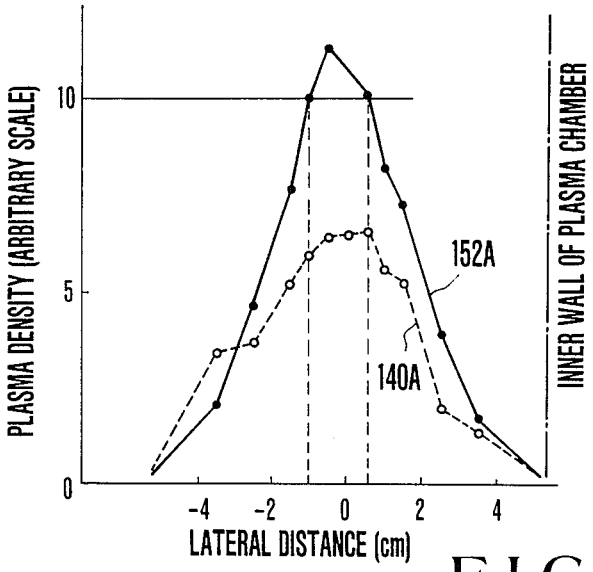
FIG. 9 is a graph for explaining a plasma density distribution in the plasma generation chamber along the radial or lateral direction thereof.

FIG. 9 shows the plasma density distribution along the radial direction of the plasma generation chamber upon changes in magnetic current for generating a magnetic field in the plasma generation chamber. A high-density plasma is generated at the central portion of the plasma generation chamber (narrow high-density plasma generation mode). The narrow high-density plasma is generated from a magnetic field having a higher intensity than that corresponding to the ECR conditions. Referring to FIG. 9, the ion extraction window of the ion extraction electrode is defined inside a center of region of the narrow high-density plasma (represented by the broken line) in order to extract high-density plasma components having a density of 10 or more, thereby obtaining a high-density high-quality ion beam.

Figure 10:
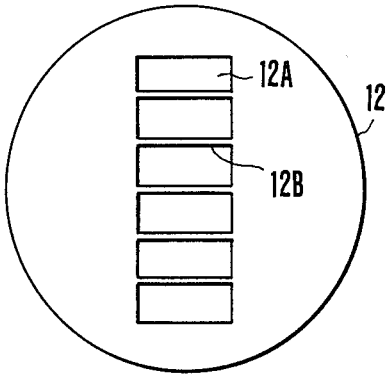
FIG. 10 is a plan view showing a plasma limiter.

In the above embodiment, by using the plasma limiter 12 having the plasma transport opening 12A, the following advantages are obtained in addition to the effect wherein only the center region of plasma is transported. First, the microwave which is not absorbed in the plasma is reflected to effectively absorb the remaining microwave in the plasma. In general, when an opening size is small, the microwave will not leak. However, when a mesh, wire or grating is arranged in the opening, as needed, the microwave can be reflected. In this case, the grating or the like can be integrally formed with the plasma limiter, as shown in FIG. 10. Referring to FIG. 10, the size of the opening 12A having rectangular apertures is about 3×7 cm while an outer diameter of the plasma limiter 12 is 10.8 cm. The distance between stripes 12B is less than 2 cm so as to prevent the microwave from leaking. A width of each stripe 12B is as small as 1 to 2 mm so as not to prevent plasma flow. Second, the plasma limiter eliminates influence of the microwave on the extraction electrode system 14 for the same reason as first given. Third, since the plasma generation chamber 7 is separated from the ion extraction electrode system 14, the plasma in the extraction electrode system 14 is stabler than that in the plasma generation chamber 7. Fourth, since the opening 12A limits the gas flow, the utilization efficiency of the gas is high. Fifth, since plasma particles and other particles drawn out as neutral particles outside the chamber are smaller in number than those of the gas in the plasma generation chamber, a change in gas pressure in the plasma generation chamber is small. Sixth, when the plasma generation chamber 7 is electrically insulated from the extraction electrode system 14 through the insulating cylindrical member 15A, a potential in the plasma generation chamber and the acceleration electrode of the extraction electrode system can be separately controlled. For example, a high voltage is applied to the plasma generation chamber 7 while the acceleration electrode 14A is held in a floating potential, and a sheath thickness between the plasma in the plasma transport chamber 13 and the acceleration electrode 14A can be self-aligned, so that the transmission state of the plasma through the respective apertures of the acceleration electrode 14A can be optimized. As a result, good extraction characteristics with respect to a wide range of ion energy can be expected. Seventh, since the gas is exhausted from the openings 16 formed on the side wall of the plasma transport chamber 13, a gas pressure and contamination level of the plasma transport chamber can be improved. Eighth, since the distance between the plasma generation chamber 7 and the extraction electrode system 14 is large enough to guarantee a spatial margin for the magnetic coil 10, the ion source design is thereby simplified. In other words, a holding portion (not shown) of the extraction electrode system 14 can be disposed as far as the lower end of the plasma generation chamber 7 without causing interference.

Figure 11:
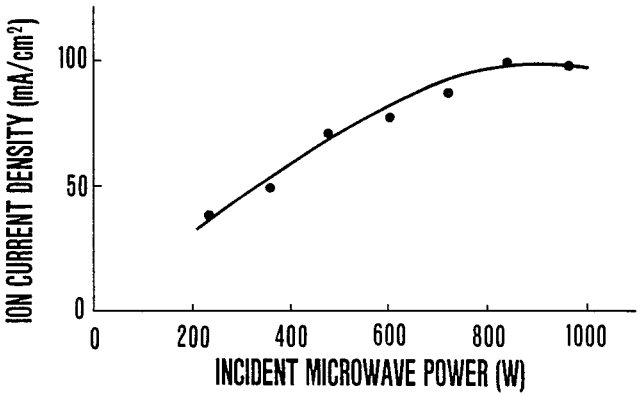
FIG. 11 is a graph showing the ion current density as a function of microwave power.

FIG. 11 shows the relationship between the ion current density of oxygen ions by the microwave ion source and the microwave power. An extraction electrode window has seven apertures arranged at a central portion of the window which has a diameter of 15 mm. Each aperture has a diameter of 4.2 mm. An ion extraction voltage is increased upon an increase in microwave power and falls within the range between 10 kV and 30 kV. An ion current density at the extraction window is 100 mA/cm$^2$ which is twice or three times that of the conventional ridged type ion source.

Figure 12:
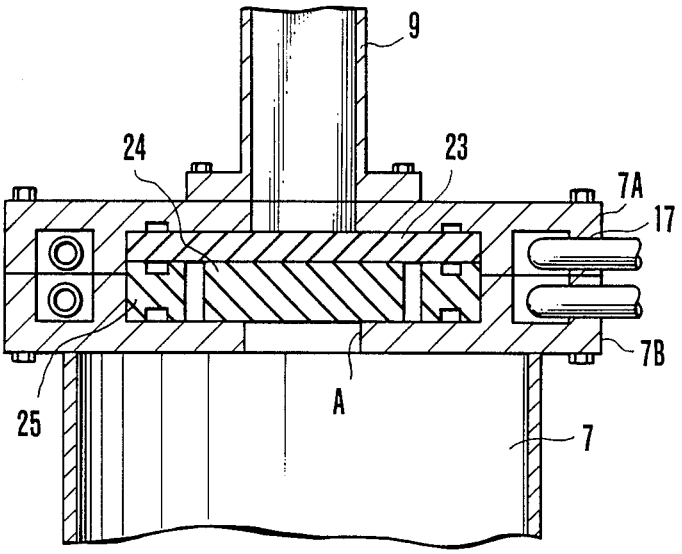
FIGS. 12 and 13 are respectively a sectional view and a plan view of a microwave introducing window.
Figure 13:
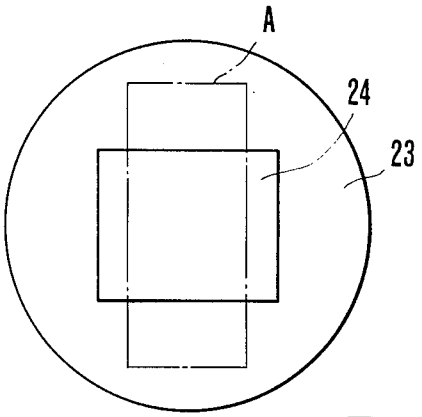

In the microwave ion source of this embodiment, when optimal ion extraction conditions cannot be obtained by various adjustment errors for gas pressure, microwave power, magnetic field intensity, and extraction voltage or by a position error between the electrodes of the extraction electrode system 14, or when an ion current flowing through the deceleration electrode 14B cannot be decreased, electrons generated by ions incident on the deceleration electrode 14B bombard against the microwave introducing window 8 at high energy throughout a magnetic field distribution. In addition, a discharge between the electrodes occurs, and a negative voltage is no longer applied to the deceleration electrode. Then flow of an electron current from outside the ion source cannot be suppressed, and the electron flow bombards against the microwave introducing window. As these electrons are accelerated by the acceleration voltage in extraction electrode system, the microwave introducing window 8 is heated and may crack by these high-speed back-stream electrodes. Accordingly, when the ion source of this embodiment is used, a current flowing through the deceleration electrode 14B must be monitored. Assume that a quartz microwave introducing window having a thickness of 10 mm is used. When electrons of 300 to 400 W (a current of back-stream electrons: ~10 mA X acceleration voltage: 40 kV) bombard against the microwave introducing window 8, the microwave introducing window 8 is locally softened. In general, a material having a small absorption of the microwave, high thermal conductivity and high thermal resistance is suitable for the microwave introducing window 8. When the window material (e.g., alumina, BeO or quartz) is properly selected and the power of ion bombardment against the deceleration electrode is monitored, no problem occurs. A safer microwave introducing window is illustrated in FIG. 12. FIG. 12 is an enlarged view of a peripheral portion of the microwave introducing window corresponding to that of FIG. 1. An auxiliary microwave introducing window 24 is arranged on the upper end portion of the plasma generation chamber 7. The auxiliary microwave introducing window 24 is adjacent to a main microwave introducing window 23 and internally of the plasma generation chamber 7. The main and auxiliary microwave introducing windows 23 and 24 are mated together with a slight gap therebetween by clamping upper and lower covers 7A and 7B. The auxiliary microwave introducing window 24 is sealed in vacuum by a vacuum sealing guard ring 25 (in order to prevent degradation of the guard ring 25, a cooling water pipe 17 is provided near the guard ring 25). A space between the main microwave introducing window 23 and the auxiliary microwave introducing window 24 is small so as not to generate a plasma therebetween. The auxiliary microwave introducing window 24 prevents high-speed back-stream electrons generated from the deceleration electrode 14B or from outside the ion source from bombarding against the main microwave introducing window 23. The insulating material preferably comprises a material (e.g. quartz, alumina, BeO, BN, AlN, ZrO, MgO or forsterite) having low microwave absorption, high thermal conductivity and high thermal resistance. With this arrangement, even if the auxiliary microwave introducing window 24 cracks, vacuum leakage will not occur, thus preventing a major damage in the ion source itself. When the auxiliary microwave introducing window 24 is disposed at a portion subjected to bombardment by speed back-stream electrons, that is, when the auxiliary microwave introducing window 24 is decreased with respect to the size of the main microwave introducing window 23 such that a portion of the main microwave introducing window 23 which is not covered with the auxiliary microwave introducing window 24 is left uncovered with respect to the inner space of the plasma generation chamber 7, as shown in FIG. 13, the power of the microwave supplied to the plasma generation chamber 7 is increased.

When the microwave introducing window comprises a double dielectric structure (multiple structure), damage thereto caused by a back stream of electrons can be prevented. The multiple structure improves plasma generation efficiency due to high efficient coupling of the introducing microwave with high-density plasma in the plasma generation chamber, and eliminates the saturation phenomenon of an ion current with respect to microwave power. In particular, a best combination is the main window 23 of quarts and the auxiliary window 24 being alumina or a double structure of alumina ($Al_2O_3$) and BN.

Figure 14:
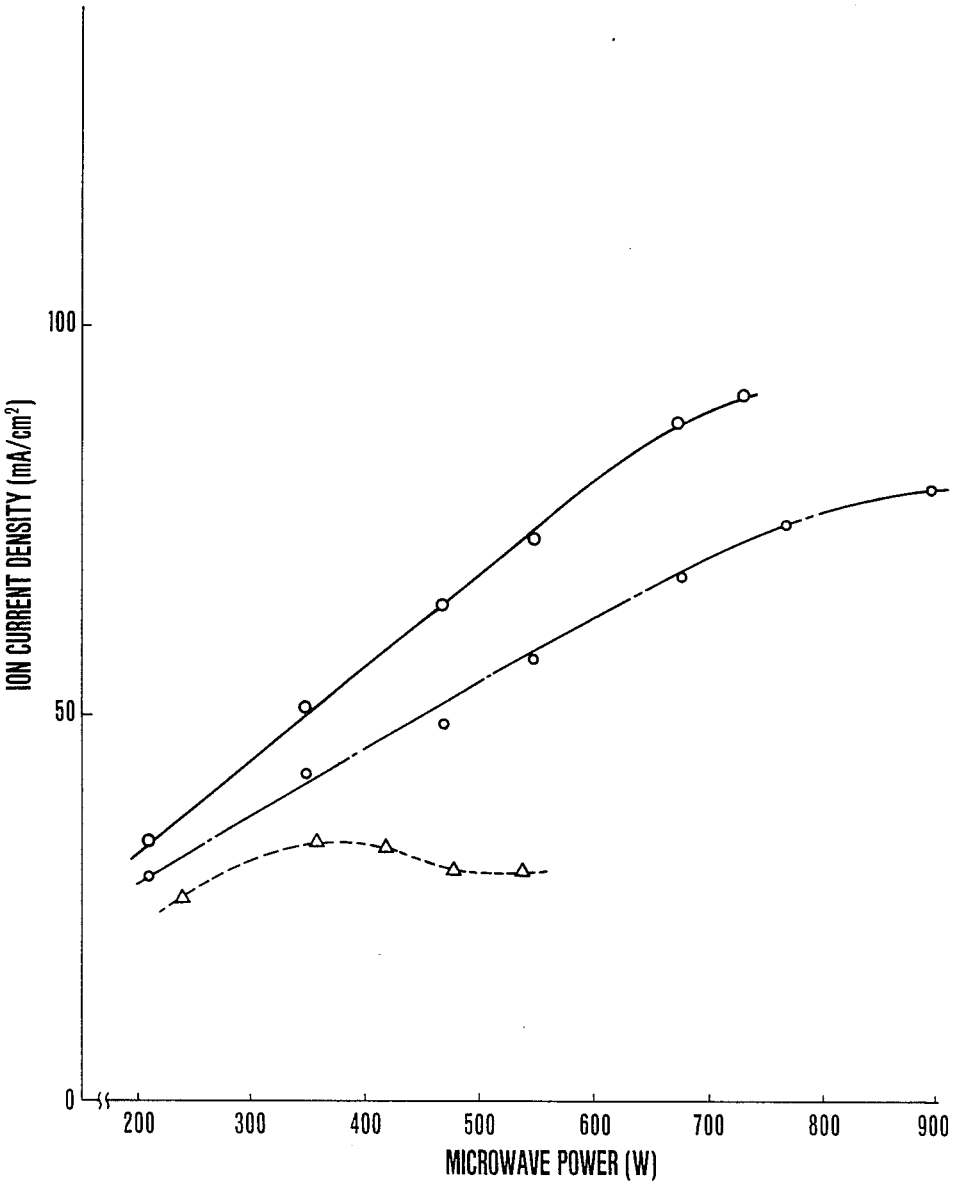
FIG. 14 is a graph for comparing the characteristics of a single-layer microwave introducing window and-a-multi-layer microwave introducing window.

The dotted, solid and alternate long and short dashed curves in FIG. 14 represent characteristics of the single-layer microwave introducing window made of only the quartz main window 23 of 15 mm thickness, a multi-layer window consisting of the quartz main window 23 of 15 mm thickness and the auxiliary window 24 made of alumina (13 mm thick, 50 mm wide, 50 mm long), and another multi-layer window consisting of the quartz main window 23 of 15 mm thickness and the auxiliary window 24 made of a combination of alumina (8 mm thick, 50 mm wide, 50 mm long) and BN (5 mm thick, 50 mm wide, 50 mm long). In the measurements, the waveguide was rectangular in shape.

Figure 15:
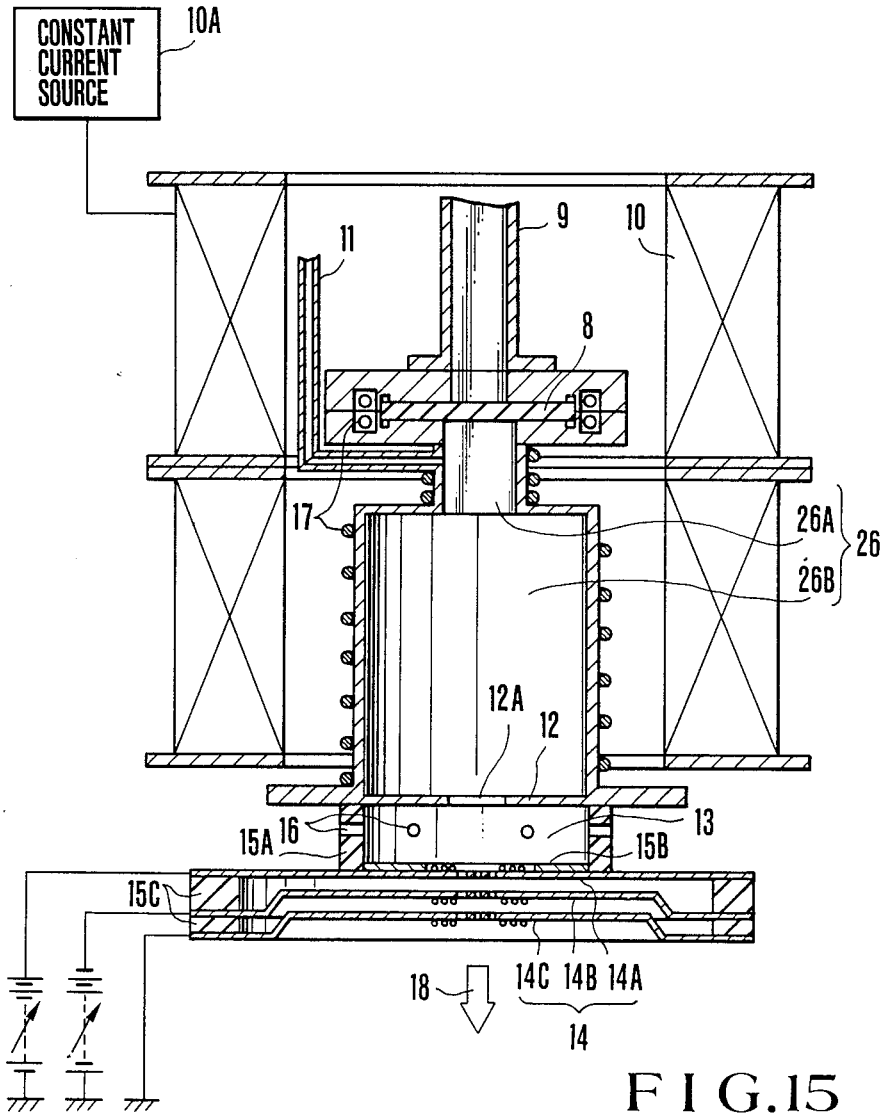
FIGS. 15 and 16 are sectional views showing microwave ion sources according to other embodiments of the present invention, respectively.

FIG. 15 is a sectional view of a microwave ion source according to another embodiment of the present invention. The same reference numerals in FIG. 15 denote the same parts as in FIG. 1, and a detailed description thereof will be omitted. An essential difference between the ion sources of FIGS. 1 and 15 is the arrangement of the plasma generation chamber. According to the embodiment shown in FIG. 15, a plasma generation chamber 26 comprises a narrow plasma generation chamber 26A and a wide plasma generation chamber 26B. For example, the narrow plasma generation chamber 26A comprises a rectangular parallelepiped cavity having the same size as that of a rectangular waveguide 9. The wide plasma generation chamber 26B comprises a cylindrical cavity having a larger size than that of the narrow plasma generation chamber 26A. However, the wide plasma generation chamber 26B may comprise a rectangular parallelepiped cavity. The narrow plasma generation chamber 26A may comprise a cylindrical or ridged cavity.

Since the plasma generation chamber 26 is arranged as described above, the microwave supplied through the rectangular waveguide 9 is supplied to the wide plasma generation chamber 26B through the narrow plasma generation chamber 26A. On the other hand, a magnetic coil 10 has a magnetic field intensity of 875 Gauss or more so as to generate the narrow high-density plasma in the narrow plasma generation chamber 26A. The magnetic field is weakened toward an extraction electrode system 14. When a gas and the microwave are supplied to the plasma generation chamber 26 and a magnetic field for occurrence of the narrow high-density plasma is generated by the magnetic coil 10 at least in the narrow plasma generation chamber 26A, a plasma is generated. In this case, a high-density plasma is generated upon an increase in microwave power density in the narrow plasma generation chamber 26A. The high-density plasma is diffused and moved in the wide plasma generation chamber 26B, thereby obtaining a more uniform high-density plasma in the wide plasma generation chamber 26B. The uniform plasma is moved by a magnetic field from a plasma transport opening 12A toward an extraction electrode system 14. In this case, when the wide plasma generation chamber 26B comprises a cavity resonance structure, the microwave can be effectively absorbed in the plasma in the wide plasma generation chamber 26B. With the above structure, the narrow high-density plasma reaches the ion extraction electrode system 14, so that ions of a high current density can be extracted. In order to fully utilize the advantage of this arrangement, the plasma generation chamber is decreased in size near the microwave introducing window to increase the power density of the microwave and is gradually increased in size toward the extraction electrode system, thereby obtaining the same effect as in this embodiment. Other structures may be proposed in addition to that of FIG. 15. According to the embodiment of FIG. 15, the plasma generation level is improved to increase its efficiency.

Figure 16:
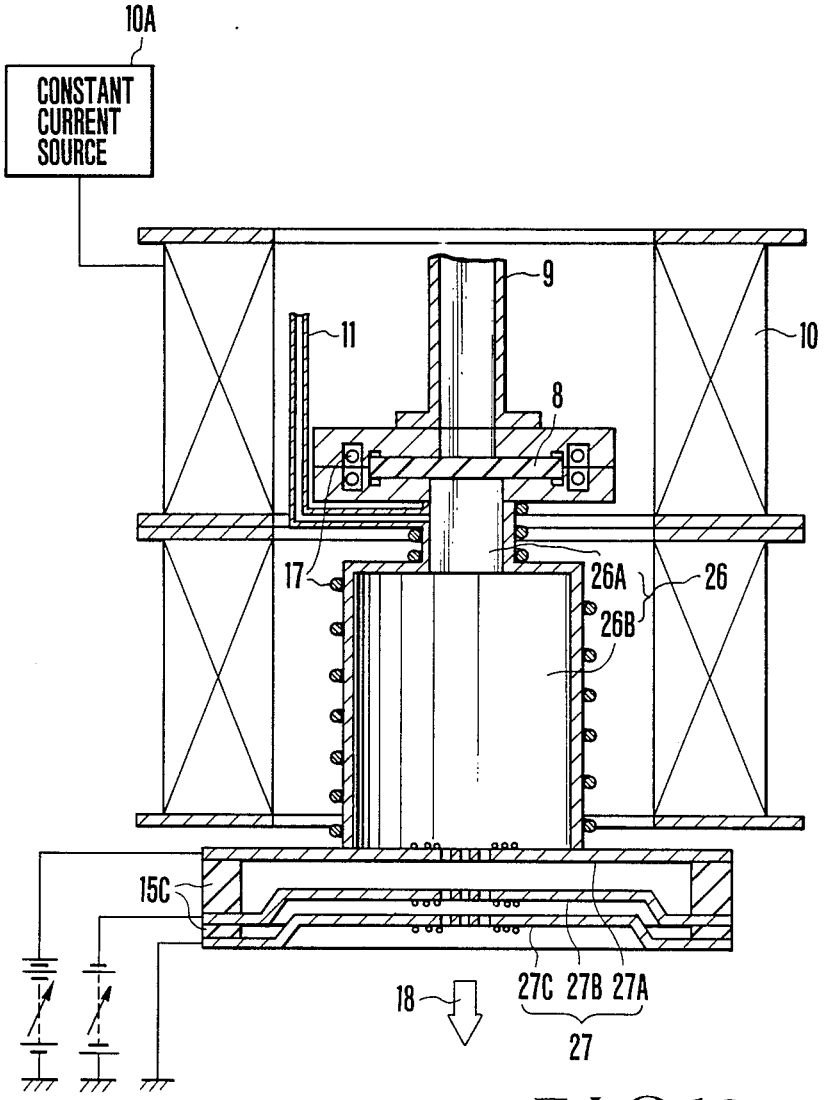

FIG. 16 is a sectional view of a microwave ion source according to still another embodiment of the present invention. According to the embodiment of FIG. 16, the plasma transport chamber 13 of FIG. 1 or 15 is omitted. An acceleration electrode 27A of an ion extraction electrode system 27 serves as the plasma transport chamber opening 12A so as to directly extract a center region of narrow high-density plasma. When variations in ion beam intensities are small due to a high density of a plasma, the plasma limiter 12 can be omitted. According to the embodiment of FIG. 16, a plasma generation chamber 26 comprises a narrow plasma generation chamber 26A and a wide plasma generation chamber 26B, as in the embodiment shown in FIG. 15. The microwaves are substantially absorbed in the narrow plasma generation chamber 26A and barely reach the vicinity of the acceleration electrode 27A. Since disturbance of the plasma is considered to be sufficiently small near the electrode 27A, stable ion beams can be extracted without necessarily providing the plasma transport chamber. In the structure without the plasma limiter 12 and the plasma transport chamber 13, as compared with the structure having both, a plasma density near the ion extraction electrode system can be increased to obtain a large ion current, resulting in convenience.

When the inner surface of the metal plasma generation chamber and the inner surface of the plasma transport chamber are subjected to a metal contamination source by ion sputtering, these inner surfaces are covered with an insulating material such as BN or quartz.

The present invention aims at obtaining an ion source for performing high-voltage extraction in the ion implanter. Referring to FIG. 1, for example, when the plasma transport opening 12A of the plasma limiter 12 is decreased in size and at the same time the ion extraction electrode system comprises a single electrode, the ion source of the present invention can also be used as a low-voltage ion or plasma source for ion deposition or etching.

According to the present invention, the following effects are obtained:

(1) A simple microwave ion source provides an ion current of a high density. Since the ratio of desired ions with respect to the total ion current is large, an ion implanter with high efficiency is provided.

(2) The ion source has long lifetime and stability for reactive gases such as oxygen and boron.

(3) When the ion source is used for forming a SIMOX substrate or modifying the surface of the layer, the throughput can be increased by 10 times or more.

(4) Since the ion source can be operated at room temperature at a low gas pressure, a material having a low vapor pressure can be used as an ion seed.

What is claimed is:

1. A microwave ion source utilizing a microwave and a magnetic field, comprising: a microwave waveguide, a plasma generation chamber having a cylindrical or rectangular cavity and having an inner wall, said chamber having a cross-section which corresponds to a plasma generation region, said plasma generation region being wider than that of said microwave waveguide, a microwave introducing window disposed at an inlet port of said plasma generation chamber for introduction of a microwave from said microwave waveguide, said microwave being introduced to said plasma generation chamber through said microwave introducing window; a magnetic circuit, arranged outside said plasma generation chamber, for generating in said plasma generation chamber a magnetic field having a higher intensity than that given by electron cyclotron resonance conditions so as to form a narrow high-density plasma portion in the center of said plasma generation region around the central axis of said plasma generation chamber, said magnetic circuit including a plurality of coils surrounding said plasma generation chamber along a longitudinal direction thereof such that said magnetic field is generated by said plurality of coils at the inlet port of said plasma generation chamber, said magnetic field being stronger near said microwave introducing window and weaker near an outlet port of said chamber such that the intensity of said magnetic field at the inlet port along the lateral direction is substantially uniform, and an ion extraction electrode system which has an ion extraction window whose contour falls within a restricted center region of said narrow high density plasma part of said plasma generation region and whose diameter is smaller than that of said plasma generation region, whereby said high density plasma portion is generated about the center portion of the plasma generation region to thereby extract a high-density ion beam and reduce the quantity of plasma which is contaminated by contact with the inner wall of said plasma generation chamber.

2. An ion source according to claim 1, wherein a central magnetic field at the inlet port of said plasma generation chamber is about 900 to 1,000 Gauss, where the microwave has a frequency of 2.45 GHz.

3. An ion source according to claim 1, wherein said microwave introducing window comprises a quartz window arranged to vacuum seal part of said plasma generation chamber.

4. An ion source according to claim 1, wherein said microwave introducing window comprises a main window arranged to vacuum seal part of said plasma generation chamber and an auxiliary window disposed adjacent to said main window and internally of said plasma generation chamber.

5. An ion source according to claim 4, wherein said main window comprises a quartz window and said auxiliary window comprises an alumina window.

6. An ion source according to claim 4, wherein said main window comprises a quartz window and said auxiliary window comprises a double layer structure of alumina and BN.

7. An ion source according to claim 1, which further comprises a plasma limiter with a plasma transport opening, said plasma limiter being arranged near the outlet port of said plasma generation chamber, said plasma transport opening opposing said ion extraction window of said ion extraction electrode system.

8. An ion source according to claim 1, wherein said ion extraction window comprises a plurality of apertures.

9. An ion source according to claim 1, wherein said ion extraction electrode system comprises an acceleration-deceleration system consisting of a plurality of electrode plates.

10. An ion source according to claim 9, wherein said ion extraction electrode system is electrically insulated from said plasma generation chamber, and said acceleration-deceleration system includes an acceleration electrode plate, a deceleration electrode plate and a ground electrode plate.

11. An ion source according to claim 1, wherein said plasma generation chamber comprises a small sectional area located near said microwave introducing window and a large sectional area located near said ion extraction electrode system.

* * * * *